United States Patent [19]

Riley

[11] Patent Number: 4,860,855

[45] Date of Patent: Aug. 29, 1989

[54] COLLAPSIBLE SAFETY ATTACHMENT FOR LADDER

[76] Inventor: Jon D. Riley, 159 Hill Dr., Vallejo, Calif. 94590

[21] Appl. No.: 169,792

[22] Filed: Mar. 17, 1988

Related U.S. Application Data

[63] Continuation-in-part of Ser. No. 83,592, Aug. 6, 1987, Pat. No. 4,770,272.

[51] Int. Cl.[4] ..... E06C 7/18

[52] U.S. Cl. ..... 182/106; 182/121; 248/210

[58] Field of Search ..... 182/106, 121, 122, 214, 182/45; 248/210

[56] References Cited

U.S. PATENT DOCUMENTS

| | | | |
|---|---|---|---|
| 1,088,525 | 2/1914 | Bottjer | 182/56 |
| 3,792,750 | 2/1974 | Madison | 182/121 |
| 4,770,272 | 9/1988 | Riley | 182/106 |

*Primary Examiner*—Reinaldo P. Machado

*Attorney, Agent, or Firm*—Townsend & Townsend

[57] ABSTRACT

An improved safety attachment for a ladder in which the attachment is collapsible to render it more compact for storing and handling purposes yet the attachment can be readily expanded for use on a ladder. The attachment includes a pair of spaced sides which are coupled together by a pair of vertically spaced cross-pieces with the cross-pieces being either removable from connection with the sides or articulated with respect to the sides so that the sides can be moved toward and away from each other to form a compact unit to facilitate storage and handling of the attachment.

11 Claims, 1 Drawing Sheet

COLLAPSIBLE SAFETY ATTACHMENT FOR LADDER

CROSS-REFERENCE TO RELATED APPLICATION

This is a continuation-in-part patent application of application Ser. No. 083,592, filed Aug. 6, 1987 and entitled "Safety Attachment for Ladder".

BACKGROUND OF THE INVENTION

1. Field of the Invention

This invention relates to improvements in safety features for ladders, and more particularly, to an attachment for a ladder to allow a person to work more safely on a pitched roof of a building structure.

2. Description of the Prior Art

In U.S. patent application Ser. No. 083,592, filed Aug. 6, 1987 and entitled "Safety Attachment for Ladder", there is disclosed a safety attachment for a ladder to permit the user of the attachment, when the attachment is on the ladder, to be locked onto the ladder so that the user will be more positively and safely connected to the ladder. The attachment also permits the person to move laterally on the ladder when the ladder is on a pitched roof so as to allow the person to perform certain tasks, such as cutting a hole in the roof with a chain saw or an ax to ventilate the roof when the roof is on fire.

The attachment set forth in the above disclosure includes a rigid frame having means thereon for removably coupling a frame to the rungs of a ladder to which the attachment is to be coupled. The frame has a pair of cross-pieces or rods which are rigidly secured to the sides of the frame and are spaced apart sufficiently to allow one leg of the user to extend partially about one of the rods while the foot or shin of the leg engages the other of the rods. In this way, when the attachment is coupled to the rungs of the ladder, the user is effectively locked onto or anchored by the attachment so that the person can move laterally of the ladder to perform certain tasks while being confident that the attachment will not separate from the ladder.

While the attachment as described in the above disclosure is satisfactory in many instances, it has been found that such an attachment is more easily handled and stored if it can be collapsed or made compact, such as being reduced in size, until ready for use; whereupon it can be expanded into a condition in which is operative on the ladder for the purposes described above. Thus, a need exists for such a collapsible attachment or ladder of the type described and the present invention satisfies this need.

SUMMARY OF THE INVENTION

The present invention is directed to an improved safety attachment for a ladder of the type described in which the attachment is collapsible to render it more compact for storing and handling purposes yet the attachment can be readily expanded for use on a ladder. Thus, the attachment is usable in a situation of the type described above in which the user is to be safely locked onto the ladder while performing certain tasks which are required, such as cutting a hole in the roof with a chain saw or an ax.

The attachment of the present invention includes a pair of spaced sides which are coupled together by a pair of vertically spaced cross-pieces with the cross-pieces being either removable from connection with the sides or articulated with respect to the side so that the sides can be moved toward and away from each other to form a compact unit to facilitate storage and handling of the attachment.

The primary object of the present invention is to provide an improved safety attachment for a ladder in which the user of the attachment can be quickly and easily locked to the ladder when the ladder is on a pitched roof wherein the attachment is collapsible to render it more compact for storage and handling purposes yet the attachment can be readily expanded into an operative condition and made ready for use in a minimum of time without sacrificing the safety features associated with the attachment.

Other objects of this invention will become apparent as the following specification progresses, reference being had to the accompanying drawings for an illustration of the invention.

DETAILED DESCRIPTION OF THE PREFERRED EMBODIMENTS

Figure 3:
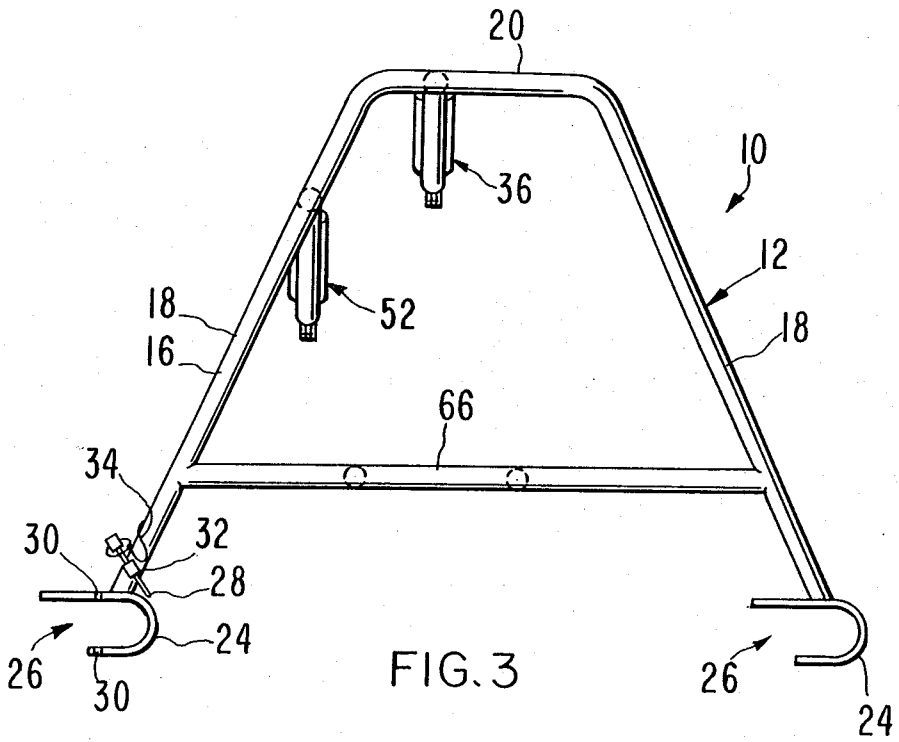
FIG. 3 is a side elevational view of the attachment of FIGS. 1 and 2 with the attachment being collapsed as is shown in FIG. 2.

The safety attachment of the present invention is broadly denoted by the numeral 10 and includes a frame 12 having a pair of opposed, generally parallel sides 14 (FIGS. 1 and 2) which are substantially identical in construction. For instance, each side 14 is comprised of a rigid tube 16, such as a tube of aluminum, Fiberglass, plastic, steel or some other lightweight material chosen for strength purposes.

Each side 14 has an A-shape in which the tube 16 of the side has a pair of inclined segments 18 which converge toward each other at the upper ends thereof, and a top segment 20 integral with the upper ends of segments 18. Thus, segments 18 and 20 are integral with each other and form a one piece tube 16.

For the lower end of each segment 18, a generally C-shaped hook 24 is rigidly secured. Each hook 24 has an open rear end 26 for receiving an adjacent rung of a ladder when the attachment 10 is to be used with the ladder. Hooks 24 can be rigidly secured in any suitable manner, such as by welding OI, to segments 18, and the spacing between the hooks is such as to permit a pair of spaced rungs of the ladder to be received in the hooks to couple the attachment 10 to the ladder. For purposes of illustration, the spacing between each pair of adjacent rungs of a ladder is 14 inches; thus, for a particular configuration of attachment 10 as shown in FIG. 1, the distance between hooks 24 is about 28 inches.

Generally, when attachment 10 is to be used with a ladder, the ladder will be on a pitched roof of a building so that the open ends 26 of hooks 24 will be at the rear of the hooks to permit the force of gravity to seat the hooks on the adjacent rungs of the ladder. In such a way, attachment 10 is positively connected to the ladder and the attachment 10 cannot be separated from the ladder except by movement of the attachment longitudinally of the ladder in a direction to cause the rungs to move out of the interiors of respective hooks 24.

For safety purposes, a pin 28 is insertable into holes 30 and 32 in at least one hook 24. Each pin 28 is held loosely in a sleeve 32 near the lower end of the corresponding segment 18 and a flexible wire or string member 34 retains the pin 28 on segment 18. Lifting of the pin out of holes 30 is required to allow clearance of the rungs and passage of the rungs out of the interior spaces of the hooks.

Figure 2:
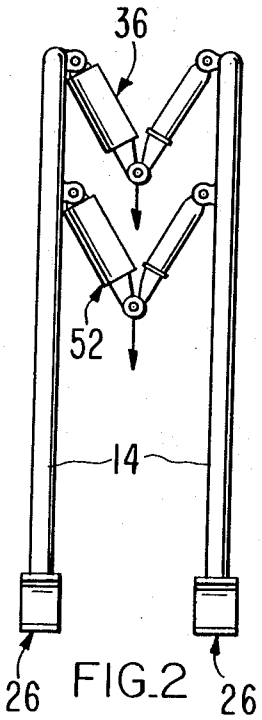
FIG. 2 is a view similar to FIG. 1 but showing the attachment in its collapsed condition suitable for storage or handling.
Figure 1:
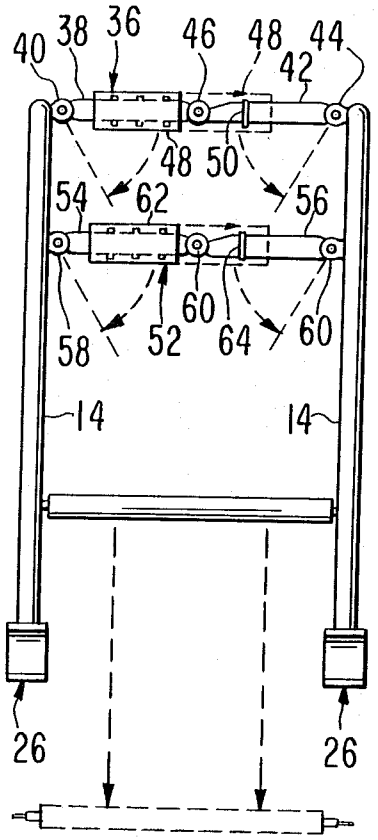
FIG. 1 is an end elevational view of the attachment of the present invention in its expanded, operative position.

A cross-piece or rod unit 36 is coupled to top segments 20 as shown in FIGS. 1 and 2. Cross-piece 36 is collapsible from the full line position shown in FIG. 1 to the full line position shown in FIG. 2. When collapsed, segments 20 are relatively close together as shown in FIG. 2; whereas, when the cross-piece 36 is expanded as shown in FIG. 1, segments 20 are relatively far apart.

Cross-piece 36 includes a first rod segments 38 coupled by a pivot means 40 to one segment 20. A second rod segment 42 is hingedly coupled by a pivot means 44 to the other segment 20. There is a third pivot means 46 pivotally interconnecting the inner ends of rod segments 38 and 42. A sleeve 48 is slidably mounted on either rod segment 38 or 42 and is movable from the full line position shown in FIG. 1 to the dashed line position shown in FIG. 1 to releasably lock the rod segments 38 and 42 in their extended conditions in which segments 20 are relatively far apart. When the sleeve 40 is in the dashed line position shown in FIG. 1, rod cross-piece 36 is longitudinally straight and is in a position to hold the sides 14 of frame 12 within their expanded position as shown in FIG. 1. Cross-piece 36 is to be used to assist in locking the leg of the user of attachment 10 in position as hereinafter described.

A second cross-piece 52 is substantially identical in construction to cross-piece 36 is provided at a location on frame 12 below cross-piece 36. Cross-piece 52 is to be used as a hand hold if necessary for the user or other person to pull himself up to a position in which his leg can be locked about the upper cross-piece 36.

Second cross-piece 52 includes a pair of rod segments 54 and 56 pivotally mounted by pivot devices 58 and 60, respectively, to respective segments 18 at the sides of frame 12. A third pivot means pivotally interconnects the inner ends of rod segments 54 and 56, and a sleeve 62 is slidably mounted on either one of rods segments 54 and 56 for movement from the full line, collapsed condition to the dashed line, expanded condition of FIG. 1. O-rings 64 are provided to frictionally hold sleeve 62 in either its collapsed or expanded condition.

Figure 4:
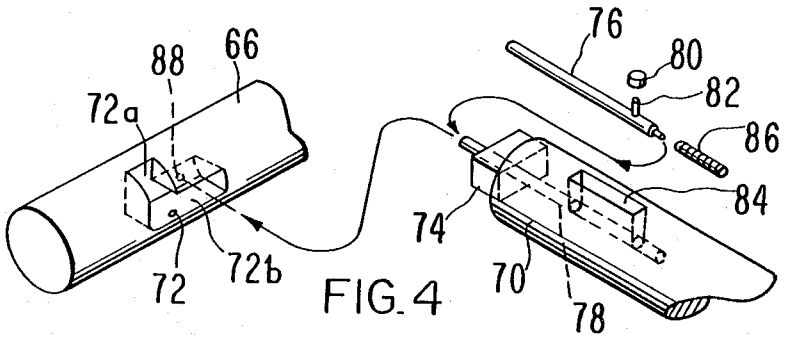
FIG. 4 is a fragmentary, perspective view of the attachment shown in a way in which one of the cross-pieces is coupled at one end thereof to the frame of the attachment.

Each side 14 has a bar 66 which is near the lower end of segments 18 (FIG. 3) and is rigidly secured at the ends thereof to segments 18. Each bar provides a support for an end of a third cross-piece 70 (FIG. 4). The cross-piece 70 is removably coupled at its ends to respective bars 66 as hereinafter described.

Each bar 66 has a notch or recess 72 which is generally L-shaped and which receives the boss 74 at a respective end of cross-piece 70. Each boss 74 is first placed in the vertical portion 72*a* of notch 72 and then rotated 90 degrees so that the boss will fit into the second, horizontal portion 72*b* of notch 72. Boss 74 shiftably carries a pin 76 in a passage 78 within boss 74 and the adjacent end portion of cross-piece 70. A knob 80 is on a shaft 82 extending through a slot 84 in cross-piece 70, and a spring 86 biases the pin outwardly of passage 78 so that the pin will be biased toward and into a hole or bore 88 in the corresponding bar 66.

The construction of bar 66 and cross-piece 70 is such as to allow the cross-piece to be removable from the two bars 66 when it is desired to collapse attachment 10 and render it more compact for storage or for easy handling. FIG. 2 shows the attachment 10 with cross-piece 70 completely removed from sides 14 of the attachment. However, the cross-piece 70 could be made in the same manner as cross-pieces 36 and 52 and still the attachment could be collapsed. Instead of collapsing downwardly as do the two cross-pieces 36 and 52 as shown in FIG. 2, cross-piece 70, if it were collapsible like cross-pieces 36 and 52, could collapse upwardly so as to collapse into the space immediately below cross-piece 52.

In use, attachment 10 is removably coupled to a ladder when the ladder is in any suitable operative position, such as on a pitched roof of a building. The attachment 10 can be carried in a collapsed condition to the ladder, whereupon the attachment can be expanded from the collapsed condition of FIG. 2 to the expanded condition of FIG. 1 by first sliding sleeves 48 and 62 into their operative, dashed line positions of FIG. 1 and then by placing cross-piece 70 in any one of two or more locations as shown in FIGS. 1 and 3 to make the attachment more comfortable for use for various degrees of pitch of a roof. At the desired location along the ladder where the attachment 10 is to be placed, hooks 24 are placed over adjacent rungs of the ladder and the attachment is allowed to move slightly rearwardly to seat the rungs in the hooks. Pin 28 is then inserted into holes 30 of the adjacent hook 24 for locking the attachment to one of the rungs of the ladder.

With attachment 10 in place on the ladder, the user places one leg over cross-piece 36 and places the lower part of the same leg against and behind cross-piece 70 while the shoe or boot of the leg is supported on a rung of the ladder. For instance, the leg will be the left leg if the user plans to perform certain acts at the right side of the ladder, whereupon the right leg will be supported on the roof part to the right of the ladder while the left leg will be anchored to attachment 10 by virtue of the fact that the upper cross-piece 36 will be behind the knee and the lower cross-piece 70 will be in front of the shin. This effectively supports the leg and thereby stabilizes the body of the user for movements in a lateral direction since the attachment cannot be separated from the ladder except by being moved forwardly of the ladder after pin 28 has been lifted from holes 30 of the adjacent hook 24. The user can then perform many different types of jobs, such as using an ax to chop a hole in the adjacent roof portion near the roof where his right leg is supported, assuming that the left leg of the user is anchored by attachment 10.

At the end of the use of the attachment 10, the leg is unlocked or separated from the attachment, whereupon the attachment is moved forwardly to cause hooks 24 to move off of the adjacent rungs of the ladder. Then the attachment can be collapsed and safely and easily carried down the ladder and the ladder can be removed from the roof in a normal fashion.

I claim:

1. A safety attachment for use with a ladder having a plurality of spaced rungs comprising:

a frame having means thereon for removably coupling the frame to at least a pair of the rungs of the ladder with the frame having a part extending outwardly from the ladder, said frame part having means for locking a leg of the user on the ladder, whereby the user can extend laterally of the ladder while remaining locked to the frame when the frame is coupled to the ladder, said frame being collapsible to reduce the size thereof.

2. A safety attachment for use with a ladder having a plurality of space rungs when the ladder extends along and is in engagement with a surface extending tranverse to the vertical comprising:

a frame having means thereon for removalbly coupling the frame to at least a pair of the rungs of the ladder with the frame having a part extending outwardly from the ladder; and a pair of cross-pieces carried by the frame part at spaced locations thereon for locking the leg of the user on the ladder, the spacing between the rod and the distance between each rod and an adjacent rung of the ladder being sufficient, when the frame is expanded, to permit one of the rods to engage the foot of the leg of the user and the other rod to engage the leg near the back of the knee, whereby the user can lock a leg to the frame and extend laterally of the ladder while remaining locked to the frame while the frame is coupled to the ladder, said cross-pieces being shiftable relative to the frame to permit the frame to move from an expanded condition with the cross-pieces being relatively far apart to a collapsed condition in which the sides are relatively close together.

3. A safety attachment for use with a ladder having a plurality of spaces rungs comprising:

a frame having means thereon for removably coupling the frame to at least a pair of the rungs of the ladder with the frame extending outwardly from the ladder, said frame having means for locking a leg of the user on the ladder, the locking means including a pair of spaced crosspieces parallel with the rungs of the ladder when the frame is Coupled to the ladder, whereby the user can extend laterally of the ladder while remaining locked to the frame when the frame is coupled to the ladder, said frame being collapsible to reduce the size thereof.

4. A safety attachment for use with a ladder having a plurality of spaced rugs comprising:

a frame having means thereon for removably coupling the frame to at least a pair of the rungs of the ladder with the frame extending outwardly from the ladder, said frame having means for locking a leg of the user on the ladder, the locking means including a pair of spaced cross-pieces, the spacing between the cross-pieces and the distance between each cross-piece and an adjacent rung of the ladder being sufficient to permit one of the cross-pieces to engage the leg near the foot and the other cross-piece to engage the leg near the back of the knee, whereby the user can extend laterally of the ladder while remaining locked to the frame when the frame is coupled to the ladder, said frame collapsible to reduce the size thereof.

5. A safety attachment for use with a ladder having a plurality of spaced rungs comprising:

a frame having a pair of sides and means thereon for removably coupling the frame to at least a pair of the rungs of the ladder with the frame extending outwardly from the ladder, said frame having means for locking a leg of the user on the ladder, said locking means including a pair of spaced cross-pieces interconnecting the sides, at least one of the cross-pieces being collapsible, whereby the user can extend laterally of the ladder while remaining locked to the frame when the frame is coupled to the ladder, said frame being collapsible to reduced the size thereof.

6. A safety attachment as set forth in claim 5, wherein the other cross-piece is removably coupled with the side and is separable therefrom when the frame is collapsed.

7. A safety attachement as set forth in claim 5, wherein the other cross-piece is collapsible.

8. A safety attachment as set forth in claim 5, wherein said one cross-piece includes a pair of rod segments pivotally coupled at the first ends thereof to respective sides of the frame, the second ends of the rod segments being pivotally coupled together, and sleeve means slidable on one of the rod segments into telescoping relationship to the other rod segments to interconnect the rod segments when the frame is expanded.

9. A safety attachment as set forth in claim 5, wherein is included a third cross-piece between the first and second cross-pieces, the third cross-piece being collapsible.

10. A safety attachment as set forth in claim 5, wherein each side has a bar, the other cross-piece being removably attached at each end thereof to a respective bar of a respective side of the frame.

11. A safety attachment as set forth in claim 10, wherein each bar has a recess and, each end of the other cross-piece having a boss removably receivable in the recess of the adjacent bar, and pin means for locking the ends of the other cross-piece in the corresponding recess of the adjacent, respective bar.

* * * * *